US007371008B2

(12) United States Patent
Bonenfant

(10) Patent No.: US 7,371,008 B2
(45) Date of Patent: May 13, 2008

(54) TAMPER-INDICATING RESEALABLE CLOSURE

(75) Inventor: Daniel M. Bonenfant, Amherst, NH (US)

(73) Assignee: Kraft Foods Holdings, Inc., Northfield, IL (US)

( * ) Notice: Subject to any disclaimer, the term of this patent is extended or adjusted under 35 U.S.C. 154(b) by 549 days.

(21) Appl. No.: 10/897,712

(22) Filed: Jul. 23, 2004

(65) Prior Publication Data

US 2006/0018569 A1 Jan. 26, 2006

(51) Int. Cl.
*B65D 33/34* (2006.01)
*B65D 5/43* (2006.01)

(52) U.S. Cl. ..... 383/5; 383/210; 383/211; 229/81; 229/87.05

(58) Field of Classification Search ..... 383/5, 383/210, 211, 203–205; 229/87.05, 81
See application file for complete search history.

(56) References Cited

U.S. PATENT DOCUMENTS 2,128,196 A * 8/1938 Vogel ..... 229/81
4,156,493 A 5/1979 Julius
4,185,754 A 1/1980 Julius
4,197,949 A 4/1980 Carlsson
4,552,269 A 11/1985 Chang
4,679,693 A * 7/1987 Forman ..... 383/203
4,840,270 A 6/1989 Caputo et al.
4,874,096 A * 10/1989 Tessera-Chiesa ..... 383/5
5,174,659 A 12/1992 Laske
5,499,757 A 3/1996 Back
5,688,394 A 11/1997 McBride, Jr. et al.
5,725,311 A 3/1998 Ponsi et al.
D394,605 S 5/1998 Skiba et al.
5,791,465 A 8/1998 Niki et al.
5,882,116 A 3/1999 Backus
5,928,749 A 7/1999 Forman
5,938,013 A 8/1999 Palumbo et al.
5,945,145 A 8/1999 Narsutis et al.
6,026,953 A * 2/2000 Nakamura et al. ..... 206/233

(Continued)

FOREIGN PATENT DOCUMENTS

EP 0 474 981 3/1992

(Continued)

*Primary Examiner*—Nathan J. Newhouse
*Assistant Examiner*—Jack Morgan
(74) *Attorney, Agent, or Firm*—Stites & Harbison PLLC; Marvin Petry

(57) ABSTRACT

A tamper indicating, resealable closure for a package includes first and second film layers releasably adhesively joined together such that the first and second film layers are at least partially separable when the second film layer is pulled away from the first film layer. The first film layer includes first and second tear lines formed thereon to define first and second panel sections respectively. The first panel section defines an access opening through the first film layer when it is separated along the first tear line during an initial separation of the first and second film layers. The second panel section also becomes separated from the first film layer when the second film layer is separated from the first film layer to provide an indication of an initial opening of the closure. Subsequently, the second film layer may be re-adhered to the first film layer to reseal the access opening, while the second panel section remains separated from the first film layer.

11 Claims, 4 Drawing Sheets

U.S. PATENT DOCUMENTS

| | | | |
|---|---|---|---|
| 6,029,809 | A | 2/2000 | Skiba et al. |
| 6,065,591 | A | 5/2000 | Dill et al. |
| 6,113,271 | A | 9/2000 | Scott et al. |
| 6,126,009 | A | 10/2000 | Shiffler et al. |
| 6,164,441 | A | 12/2000 | Guy et al. |
| D447,054 | S | 8/2001 | Hill |
| 6,309,105 | B1 | 10/2001 | Palumbo |
| 6,420,006 | B1 | 7/2002 | Scott |
| 6,428,867 | B1 | 8/2002 | Scott et al. |
| 6,461,043 | B1 | 10/2002 | Healy et al. |
| 6,517,243 | B2 | 2/2003 | Huffer et al. |
| 6,746,743 | B2 | 6/2004 | Knoerzer et al. |
| 6,767,604 | B2 | 7/2004 | Muir, Jr. et al. |
| 6,918,532 | B2 * | 7/2005 | Sierra-Gomez et al. .. 229/87.08 |
| 6,983,875 | B2 * | 1/2006 | Emmott ..... 229/313 |
| 7,007,423 | B2 * | 3/2006 | Andersson et al. ..... 40/674 |
| 2003/0210838 | A1 | 11/2003 | Steele |

FOREIGN PATENT DOCUMENTS

| | | |
|---|---|---|
| EP | 1 375 380 | 1/2004 |
| FR | 1327914 | 4/1963 |

* cited by examiner

TAMPER-INDICATING RESEALABLE CLOSURE

FIELD OF INVENTION

The present invention relates generally to packages for storing articles, and more particularly to a tamper-indicating, resealable closure for such packages.

BACKGROUND OF THE INVENTION

Many products are supplied in sealed bags, pouches or other packages formed from thin films or other flexible materials. For example, foodstuffs, tobacco products, small parts or loose items such as pharmaceuticals or medical accessories are commonly provided in pouches or bags formed from flexible film material. Many of these types of packages are provided with tear strips that facilitate opening the package. Moreover, it is known to provide resealing capability to such packages through the use of an adhesive disposed on a portion of the flexible package material that has been separated by the tear strip.

In some applications, it is desired to further construct the package or pouch to provide an indication of initial opening so that any tampering with the package or its contents may be discovered. Conventional tampering indicating devices include printed tapes that can be applied to the package and which are configured to reveal a message in the form of textural indicia, patterns or symbols when the tape seal is initially broken. Incorporation of such tamper indicating tapes increases the time and expense of manufacturing such packages.

Previous resealable packages have been constructed from two layers of flexible film material that are joined together. The first layer defines the outer packaging material and the second forms a panel or flap that can be separated from the first layer to expose an opening in the package. The first and second film layers typically are printed with graphics and indicia to indicate the contents of the package. One drawback of this type of packaging arrangement is that the first and second layers must be precisely registered prior to joining the layers, so that the printed indicia and graphics are in proper alignment on the finished package. The need to precisely register the film layers imposes additional requirements for automated packaging lines and may limit the operating speed of the equipment. Moreover, high scrap rates can result when the film layers drift out of register during operation.

A need therefore exists for a tamper-indicating resealable closure that does not increase the cost of packaging and which can easily be incorporated into the flexible materials used to form pouches, bags or other flexible packages.

SUMMARY OF THE INVENTION

The present invention provides a tamper-indicating resealable closure that can be readily incorporated in to the outer film material of a bag, pouch, or other flexible package. The closure is formed directly on the film material and does not require precise registration of individual layers to align graphics or textual indicia. Moreover, the closure provides an easily identifiable visual indication of initial opening, without requiring pre-printed tamper-indicating tapes to be added to the packaging material.

In one embodiment, the closure comprises first and second film layers that are releasably adhesively joined together so that the second film layer can be peeled back, or otherwise separated, from the first film layer. The first film layer forms the outer portion of the package and the second film layer is transparent, whereby graphics and textual indicia printed on the first film layer are visible through the second film layer. The closure further includes first and second tear lines formed into the first film layer beneath the second film layer. The first tear line defines a first panel section that creates an access opening through the first film layer when the second film layer is peeled back. The second tear line defines a second panel section that serves to indicate the initial opening of the package.

When the second film layer is peeled back, the first and second panel sections, which are adhesively secured to the second film layer, separate from the first film layer, along the first and second tear lines, respectively. The second tear line is configured such that a portion of the second panel section remains integrally joined to the first film layer, and the second panel section eventually becomes separated from the second film layer upon opening the closure. In another embodiment, the first film layer is formed such that the second panel section is biased to move in a direction away from the second film layer after it has separated from the first and second film layers. Accordingly, when the second film layer is repositioned against the first film layer to re-seal the package, the absence of the second panel creates a void that provides a visual indication of initial opening.

Still other embodiments, examples, features, aspects, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

BRIEF DESCRIPTION OF THE DRAWINGS

While the specification concludes with claims which particularly point out and distinctly claim the invention, it is believed the present invention will be better understood from the following description taken in conjunction with the accompanying drawings, in which like reference numerals identify the same elements and in which:

DETAILED DESCRIPTION

Figure 1:
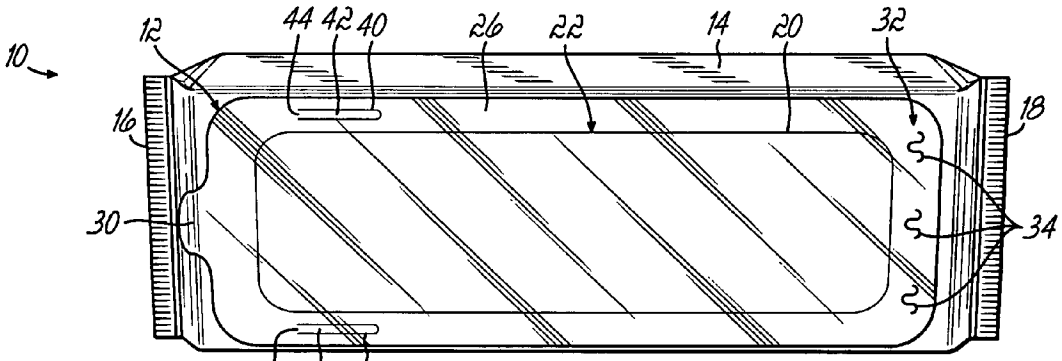
FIG. 1 is a perspective view of a package including an exemplary closure according to the present invention.

Referring to FIG. 1, there is shown a package 10 including an exemplary tamper-indicating, resealable closure 12 according to the present invention. The outer portion of the package 10 includes a first film layer 14, formed from polymeric film or other flexible material, that has been cut, folded, or otherwise processed to define an interior space or receptacle for receiving the product or items to be provided within the package 10. In the embodiment, the longitudinal ends 16, 18 of the package 10 are sealed to enclose the contents of the package 10. This type of packaging is conventionally used to store and distribute foodstuffs such as cookies, crackers and candy, or other items such as tissues or medical wipes. While not depicted in FIG. 1, the first film layer 14 may include graphic or other indicia that identify the contents of package 10.

The exemplary closure to 12 is formed directly on the first film layer 14 and includes a first tear line 20 formed into the first film layer 14. The first tear lined 20 defines a first panel 22 that may be separated from the first film layer 14, along the tear line 20, to expose an opening 24 (see FIG. 4) whereby access to the contents of the package 10 may be gained. The closure 12 further includes a second film layer 26 disposed on top of the first film layer 14 and extending beyond the periphery of the first tear line 20 to thereby cover the first panel section 22. The side of the second film layer 26 that faces the first film layer 14 is coated with an adhesive 28 (see FIGS. 3-5) so that the second film layer 26 may be releasably secured to the first film layer 14. The adhesive-coated second film layer 26 helps to keep the first panel section 22 joined to the first film layer 14 until it is desired to open the package 10.

In the embodiments shown and described herein, the second film layer 26 is provided with a tab 30 or other gripping feature, which is not coated with adhesive 20, so that the second film layer 26 may be peeled back from the first film layer 14 to open the package 10. The second film layer 26 may further include a hinge portion 32, depicted in FIGS. 1 and 2 as a series of undulating die cuts 34 formed through the second film layer 26 along a peripheral edge positioned opposite the tab 30. As the second film layer 26 is peeled back, the undulating die cuts 34 help to keep the edge of the second film layer 26 adhesively secured to he first film layer 14, while permitting the second film layer 26 to be moved away from the access opening 24 to facilitate access to the contents of the package 10. While the hinge portion has been shown and described herein as comprising as series of undulating due cuts 34, it will be recognized that the hinge portion 32 may comprise a fold line defining a living hinge, or any other arrangement suitable for hingedly coupling the second film layer 26 to the first film layer 14.

Figure 2:
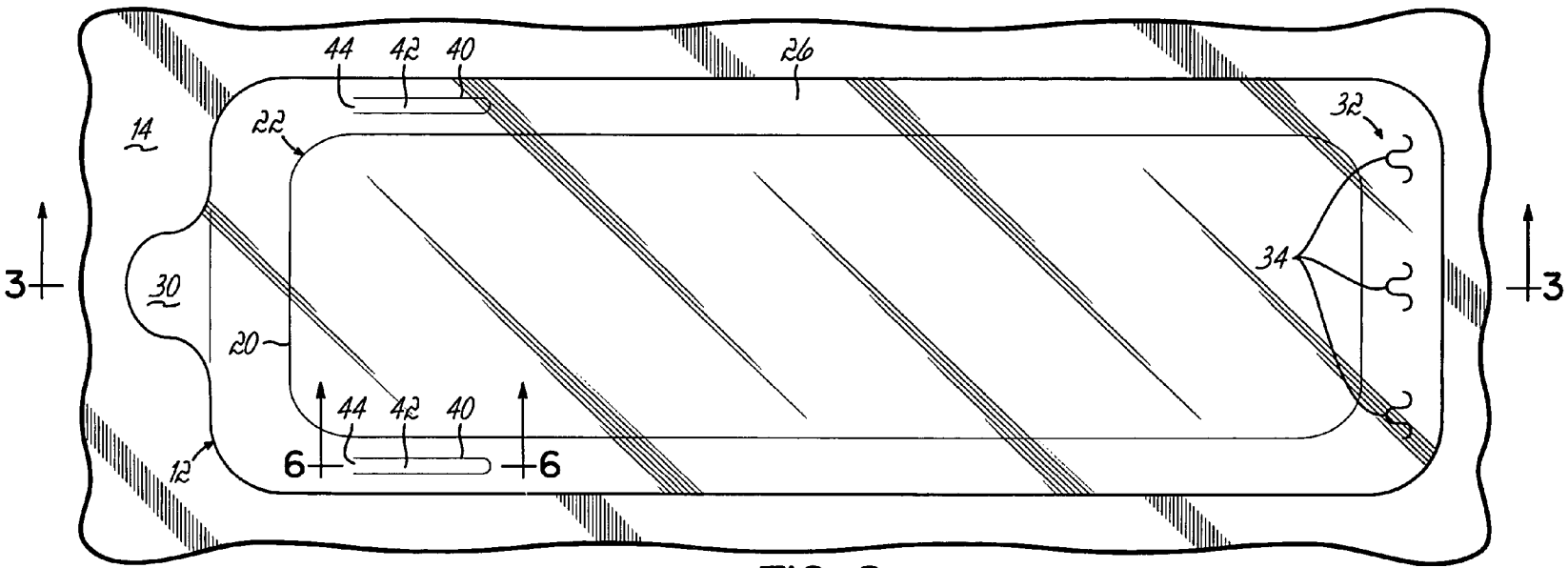
FIG. 2 is an enlarged plan view of the closure depicted in FIG. 1.
Figure 3:
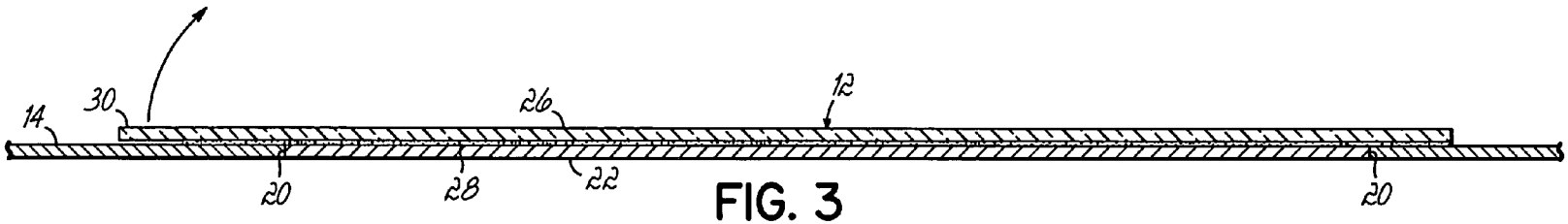
FIG. 3 is a cross-sectional view of the closure of FIG. 2, taken along line 3-3.
Figure 4:
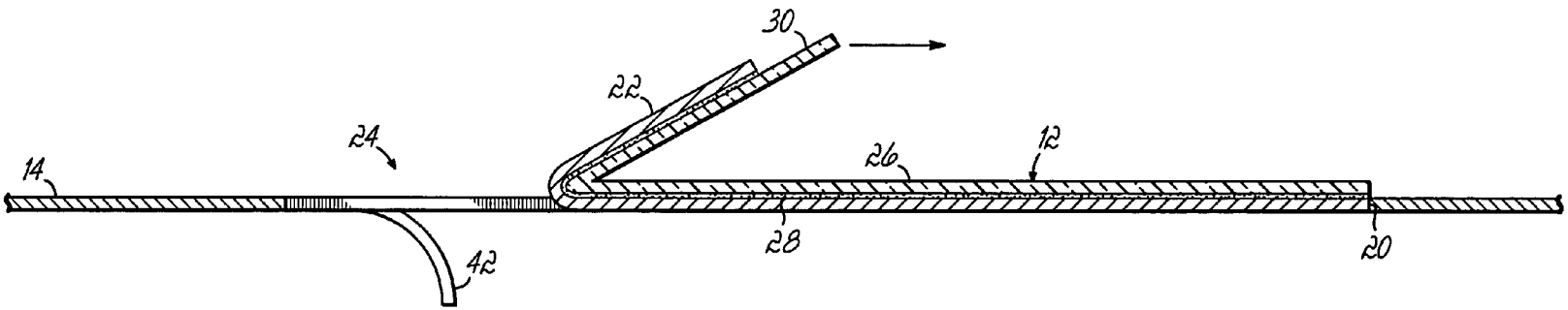
FIG. 4 is a cross-sectional view of the closure of FIG. 3, depicting an initial opening of the closure.
Figure 5:
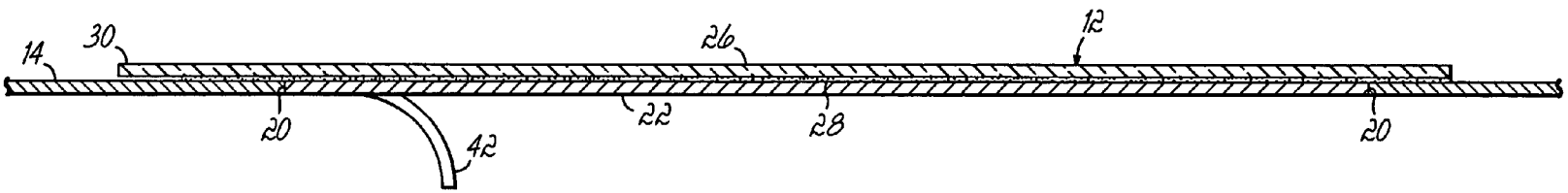
FIG. 5 is a cross-sectional view of the closure of FIG. 3, depicting a resealed configuration of the closure after the initial opening.

With continued reference to FIGS. 1 and 2, and referring further to FIGS. 3 and 4, the first panel section 22 is separated from the first film layer 14 along the first tear line 20 and remains adhered to the second film layer 26 as the second film layer 26 is peeled back to open the package 10. After the contents of the package 10 have been accessed and is it desired to reseal the package 10, the second film layer 26 may be reapplied to the first film layer 14, approximately in its original position, as depicted in FIG. 5. Because the second film layer 26 extends beyond the periphery of the first panel section 22, the adhesive 28 disposed thereon facilitates resealing the package 10 with the first panel section 22 positioned over the access opening 24.

Advantageously, the second film layer 26 may be formed from a transparent film material whereby the graphics and other indicia on the first film layer 14 may be readily viewed through the second film layer 26. When the second film layer 26 is transparent, it will be recognized that a transparent adhesive should also be selected, so as not to detract from the aesthetics of the first film layer graphics and indicia. Such a construction permits the closure 12 to be formed directly on the first film layer 14 without requiring corresponding graphics to be formed on the second film layer 26, and without requiring precise registration between the first and second film layers 14, 26.

Figure 7:
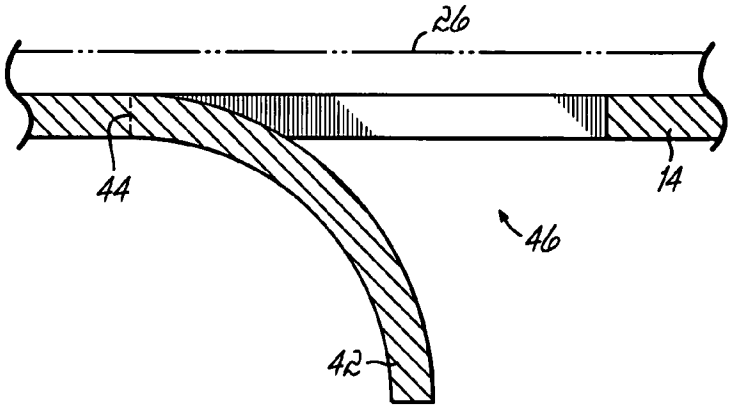
FIG. 7 is a cross sectional view of the closure depicted in FIG. 6, after an initial opening of the closure.
Figure 8:
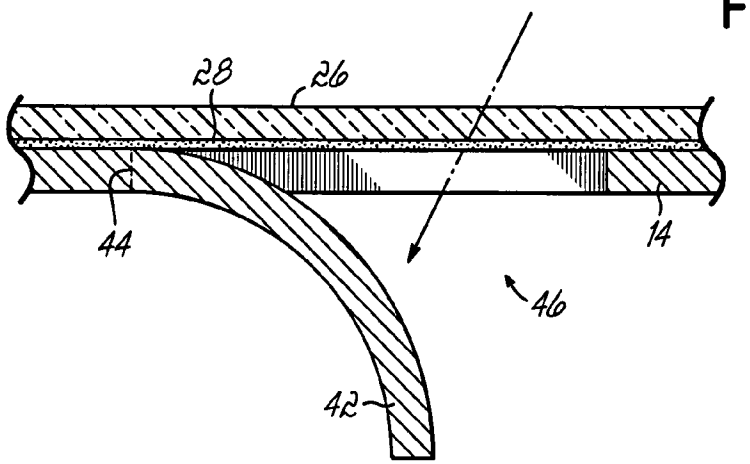
FIG. 8 is a cross-sectional view of the closure of FIGS. 6 and 7, depicting a resealed condition of the closure.
Figure 6:
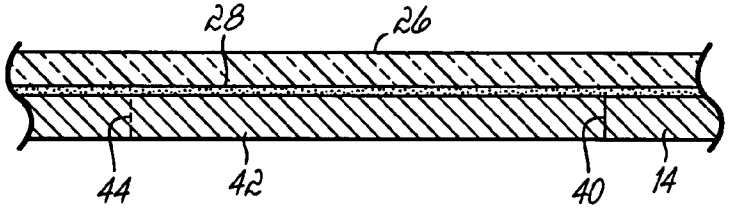
FIG. 6 is an enlarged cross-sectional view of the closure of FIG. 2, taken along line 6-6.

With continued reference to FIGS. 1-5, and referring further to FIGS. 6-8, the closure 12 further includes at least one second tear line 40 formed into the first film layer 14, adjacent the first tear line 20 and outside the periphery of the first panel section 22. In the embodiment shown, the second tear line 40 has a generally elongated u-shape such that a second panel section 42 formed by the second tear line 40 remains integrally joined with the first film layer 14 along one side of the panel. Accordingly, when the second film layer 26 is peeled away from the first film layer 14 to separate the first panel section 22, a portion of the second panel section 42 is separated from the first film layer 14, but the integrally joined portion 44 of the second panel 42 ensures that the second panel 42 does not become completely separated from the first film layer 14. The second panel 42, therefore, remains attached to the first film layer 14, and eventually becomes separated from the adhesive-coated second film layer 26 as the second film layer 26 is peeled back.

Figure 9:
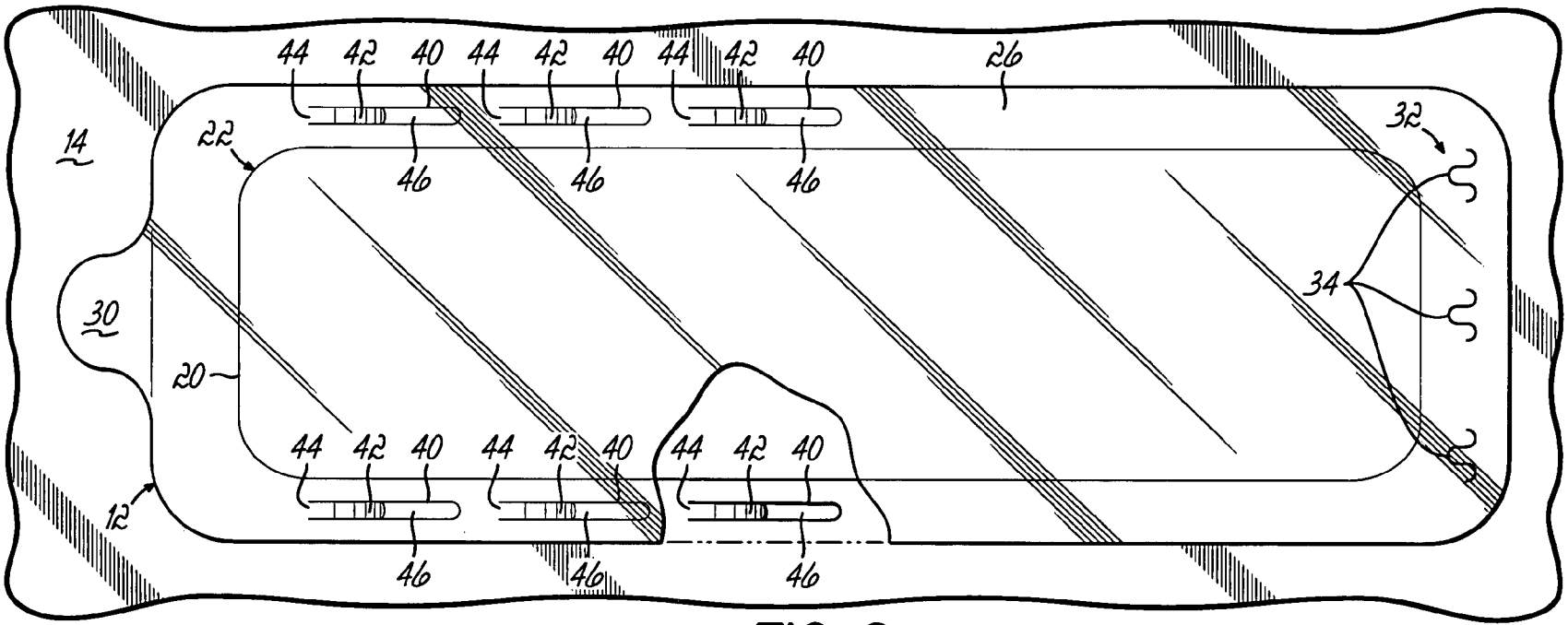
FIG. 9 is a plan view of another embodiment of a closure according to the present invention.

In another embodiment, the material of the first film layer 14 is formed such that the second panel section 42 is biased to move in a direction away from the second film layer 26, and inwardly of the package 10, when it becomes separated from the first and second film layers 14, 26, as depicted in FIGS. 4 and 7. Thereafter, the second panel section 42 provides a visual indication of an initial opening of the package 10, even when the second film layer 26 is resealed against the first film layer 14 to reclose the package 10. Specifically, the second panel section 42 remains joined to the first film layer 14 at one end while the remainder of the second panel section 26 extends downwardly into the package 10, as depicted in FIGS. 4, 5, 7 and 8, to create a void area 46 that is visually detectable when viewing the package 10, as depicted in FIG. 9. Because the second panel section 26 remains joined at one end to the first film layer 14, the second panel section 26 remains tethered to the package 10 and will not become intermingled with the contents therein.

While FIGS. 1 and 2 show and describe two second panel sections 42 having a generally elongate shape, it will be recognized that the closure 12 may alternatively have only one second panel section 42 for indicating an initial opening of the package 10, or several second panel sections 42, as depicted in FIG. 9. Moreover, it will be recognized that the second panel section 42 may have shapes or configurations other than the elongate panel section shown and described herein.

The first film layer 14 may be formed from polypropylene, polyethylene, cellophane, or any other polymeric material suitable for forming a package enclosure. Likewise, the second film layer 26 may be formed from polypropylene, polyethylene or any other polymeric material suitable for forming a selectively releasable and resealable cover that can be adhered to the first film layer 14, as described above. When the package 10 will contain foodstuffs, the adhesive 28 material should be an adhesive approved by the U.S. Food and Drug Administration, or equivalent agency, for such use. Otherwise the adhesive 28 may be any adhesive suitable for releasably securing the first and second film layers 14, 26. In an exemplary embodiment, the adhesive is an emulsion based acrylic. It will be recognized, however, that other types of adhesives could be used as well.

The first film layer 14 may be manufactured to bias the second panel section 42 in a direction away from the second film layer 26, as discussed above. This may be accomplished in various ways, such as by forming the first film layer 14 as a laminated film having tension induced in selected layers, such that the direction of curl of the second panel section 42 is controlled as desired; by coating the first film layer 14 with a material having shrinking properties; by applying a static charge to the first film layer 14; by co-extruding multiple layers and controlling the direction of curl by orienting the layers of the co-extruded film; or by other methods which cause the second panel section 42 to be biased in a desired direction.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A tamper-indicating resealable closure, comprising:

a first film layer;

a first tear line formed into said first film layer and defining a first panel section for providing an access opening through said first film layer when separated from said first film layer along said first tear line;

a second tear line formed into said first film layer, adjacent said first tear line, and defining a second panel section for indicating an initial opening of the closure when separated from said first film layer along said second tear line; and a second film layer disposed on said first film layer and covering said first and second panel sections, said second film layer including an adhesive layer for releasably adhering said second film layer to said first film layer such that said first panel section is separated from said first film layer to expose the access opening, and said second panel section is separated from said first and second film layers to provide a visual indication of opening when said second film layer is urged away from said first film layer.

2. The closure of claim 1, wherein said second tear line is arranged such that at least a portion of said second panel remains integrally joined to said first film layer.

3. The closure of claim 2, wherein said second film layer includes an exposed end to facilitate pulling said second film layer away from said first film layer, and wherein said second panel is formed such that said second tear line extends from said integrally joined portion of said second panel in a direction corresponding to a direction that said second film layer is pulled away from said first film layer.

4. The closure of claim 1, wherein said first film layer is configured such that said second panel section is biased in a direction away from said second film layer when said second film layer is urged away from said first film layer.

5. The closure of claim 1, further comprising a hinge formed on said second film layer.

6. The closure of claim 1, comprising at least two second tear lines defining at least two second panels proximate said first tear line.

7. The tamper-indicating closure of claim 1, wherein the second tear line forms a second panel having an elongated shape.

8. A container, comprising:

a packaged formed from a first film layer; and a resealable tamper evident closure formed into said first film layer, said closure comprising:

a first tear line formed into said first film layer and defining a first panel section for providing an access opening through said first film layer when separated from said first film layer along said first tear line;

a second tear line formed into said first film layer, adjacent said first tear line, and defining a second panel section for indicating an initial opening of the closure when separated from said first film layer along said second tear line; and a second film layer disposed on said first film layer and covering said first and second panel sections, said second film layer including an adhesive layer for releasably adhering said second film layer to said first film layer such that said first panel section is separated from said first film layer to expose the access opening, and said second panel section is separated from said first film layer to provide a visual indication of opening when said second film layer is urged away from said first film layer.

9. The container of claim 8, wherein said second tear line is arranged such that at least a portion of said second panel remains integrally joined to said first film layer.

10. The tamper-indicating closure of claim 8, wherein the second tear line forms a second panel having an elongated shape.

11. The container of claim 8, further comprising a product comprising food stuff.

* * * * *

UNITED STATES PATENT AND TRADEMARK OFFICE

CERTIFICATE OF CORRECTION

PATENT NO. : 7,371,008 B2
APPLICATION NO. : 10/897712
DATED : May 13, 2008
INVENTOR(S) : Bonenfant It is certified that error appears in the above-identified patent and that said Letters Patent is hereby corrected as shown below:

In column 6, line 50, please change "food stuff" to --foodstuff--.

Signed and Sealed this

Eighth Day of September, 2009

David J. Kappos

David J. Kappos
*Director of the United States Patent and Trademark Office*